US006135940A

United States Patent [19]

Walters

[11] Patent Number: 6,135,940

[45] **Date of Patent: *Oct. 24, 2000**

[54] CENTRIFUGALLY ACTIVATED TUBE ROTATOR MECHANISM AND METHOD FOR USING THE SAME

[75] Inventor: Michael R. Walters, Baltimore, Md.

[73] Assignee: Becton, Dickinson and Company, Franklin Lakes, N.J.

[ * ] Notice: This patent is subject to a terminal disclaimer.

[21] Appl. No.: 09/210,332

[22] Filed: Dec. 11, 1998

Related U.S. Application Data

[63] Continuation-in-part of application No. 09/032,931, Mar. 2, 1998, and a continuation-in-part of application No. 08/918,437, Aug. 26, 1997, abandoned, and a continuation-in-part of application No. 08/918,473, Aug. 26, 1997, abandoned, and a continuation-in-part of application No. 08/721,782, Sep. 25, 1996, abandoned.

[51] Int. Cl.[7] ..... B04B 7/00

[52] U.S. Cl. ..... 494/19; 494/37

[58] Field of Search ..... 494/1, 11, 16, 494/19, 20, 31, 33, 37, 47; 366/217; 422/72

[56] References Cited

U.S. PATENT DOCUMENTS

| | | | |
|---|---|---|---|
| 1,011,929 | 12/1911 | Ecaubert | 494/33 |
| 1,044,570 | 11/1912 | Raasloff et al. | 494/33 |
| 3,199,775 | 8/1965 | Drucker | 494/19 |
| 3,235,173 | 2/1966 | Unger | 494/19 |
| 3,768,727 | 10/1973 | Proni | 494/19 |
| 3,848,796 | 11/1974 | Bull | 494/19 |
| 3,882,716 | 5/1975 | Beiman | 494/19 |
| 4,131,369 | 12/1978 | Gordon et al. | 494/19 |
| 4,479,720 | 10/1984 | Mochida et al. | 494/19 |
| 4,555,183 | 11/1985 | Thomas | 366/208 |
| 4,776,832 | 10/1988 | Martin et al. | 494/19 |
| 4,812,294 | 3/1989 | Combs | 422/72 |
| 4,848,917 | 7/1989 | Benin et al. | 366/208 |
| 5,045,047 | 9/1991 | Hutchins et al. | 494/19 |
| 5,104,807 | 4/1992 | Mitsumaki et al. | 494/19 |
| 5,195,825 | 3/1993 | Ringrose | 366/213 |
| 5,380,087 | 1/1995 | Haber et al. | 366/208 |
| 5,888,184 | 3/1999 | Wardlaw . | |
| 5,889,584 | 3/1999 | Wardlaw . | |

FOREIGN PATENT DOCUMENTS

| | | | |
|---|---|---|---|
| 1002029 | 3/1983 | U.S.S.R. | 494/19 |

*Primary Examiner*—Charles E. Cooley
*Attorney, Agent, or Firm*—Bruce S. Weintraub, Esq.

[57] ABSTRACT

An apparatus is disclosed for use in a centrifuge apparatus to rotate a fluid tube about its longitudinal axis while the rotor of the centrifuge apparatus is rotating the fluid tube in a rotational direction transverse to the longitudinal axis of the tube. The apparatus comprises a cam which is mechanically coupled to the fluid tube, and a cam follower configured to apply a driving force to the cam to cause the cam to rotate, which in turn rotates the fluid tube about its longitudinal axis. The cam follower applies the driving force to the cam in response to changes in the magnitude of centrifugal force applied to the cam follower caused by increases and decreases in the speed of rotation of the rotor. The centrifuge apparatus can therefore obtain optical readings of the centrifuged sample from different locations about the circumference of the fluid tube.

19 Claims, 11 Drawing Sheets

CENTRIFUGALLY ACTIVATED TUBE ROTATOR MECHANISM AND METHOD FOR USING THE SAME

CROSS-REFERENCE TO RELATED APPLICATIONS

This is a continuation-in-part application of U.S. patent application Ser. No. 09/032,931, filed on Mar. 2, 1998, and of U.S. patent application Ser. Nos. 08/918,437 and 08/918,473, both filed on Aug. 26, 1997, now abandoned, as continuations-in-part of U.S. patent application Ser. No. 08/721,782, filed on Sep. 25, 1996, now abandoned. The entire contents of each of of the foregoing U.S. patent applications is expressly incorporated herein by reference.

Related subject matter is disclosed in a U.S. patent application of Stephen C. Wardlaw entitled "Assembly for Rapid Measurement of Cell Layers", Ser. No. 08/814,536, filed on Mar. 10, 1997 which has issued as U.S. Pat. No. 5,889,584; in a U.S. patent application of Stephen C. Wardlaw entitled "Method for Rapid Measurement of Cell Layers", Ser. No. 08/814,535, filed on Mar. 10, 1997 which has issued as U.S. Pat. No. 5,888,184; in a U.S. patent application of Edward G. King, Michael A. Kelly, Bradley S. Thomas and Michael R. Walters entitled "Disposable Blood Tube Holder and Method for Using the Same", Ser. No. 09/033,373, filed on Mar. 2, 1998; in a U.S. patent application of Bradley S. Thomas, Michael A. Kelly, Michael R. Walters, Edward M. Skevington and Paul F. Gaidis entitled "Blood Centrifugation Device with Movable Optical Reader", Ser. No. 09/033,368, filed on Mar. 2, 1998; and in a U.S. patent application of Bradley S. Thomas, entitled "Flash Tube Reflector With Arc Guide", Ser. No. 09/032,935, filed on Mar. 2, 1998, which issued as U.S. Pat. No. 6,030,086 all of said applications being expressly incorporated herein by reference.

BACKGROUND OF THE INVENTION

The present invention relates generally to a device, preferably for use in a blood centrifuge apparatus, which rotates a fluid tube about its longitudinal axis while the fluid tube is being rotated by the centrifuge apparatus. More particularly, the present invention relates to a device which is coupled to the rotor of a blood centrifuge apparatus, and which is actuated by centrifugal force generated by rotation of the centrifuge rotor to rotate a blood tube carried by the rotor about an axis substantially corresponding to the longitudinal axis of the blood tube, while the rotor is spinning the blood tube, so that successive images of the centrifuged blood can be obtained from different locations about the circumference of the blood tube.

As part of a routine physical or diagnostic examination of a patient, it is common for a physician to order a complete blood count for the patient. The patient's blood sample may be collected in one of two ways. In the venous method, a syringe is used to collect a sample of the patient's blood in a test tube containing an anticoagulation agent. A portion of the sample is later transferred to a narrow glass capillary tube, known as a fluid tube or blood tube. The open end of the fluid tube is placed in the blood sample in the test tube, and a quantity of blood enters the fluid tube by capillary action. In the capillary method, the syringe and test tube are not used and the patient's blood is introduced directly into fluid tube from a small incision or puncture made in the skin. In either case, the fluid tube is then placed in a centrifuge, such as the Model 424740 centrifuge manufactured by Becton Dickinson and Company.

In the centrifuge, the fluid tube containing the blood sample is rotated at a desired speed (typically 8,000 to 12,000 rpm) for several minutes. The high speed centrifugation separates the components of the blood by density. Specifically, the blood sample is divided into a layer of red blood cells, a buffy coat region consisting of layers of granulocytes, mixed lymphocytes and monocytes, and platelets, and a plasma layer. The length of each layer can then be optically measured, either manually or automatically, to obtain a count for each blood component in the blood sample. This is possible because the inner diameter of the fluid tube and the packing density of each blood component are known, and hence the volume occupied by each layer and the number of cells contained within it can be calculated based on the measured length of the layer. Exemplary measuring devices that can be used for this purpose include those described in U.S. Pat. Nos. 4,156,570 and 4,558,947, both to Stephen C. Wardlaw, and the QBC® "AUTOREAD" hematology system manufactured by Becton Dickinson and Company.

Several techniques have been developed for increasing the accuracy with which the various layer thickness in the centrifuged blood sample can be determined. For example, because the buffy coat region is typically small in comparison to the red blood cell and plasma regions, it is desirable to expand the length of the buffy coat region so that more accurate measurements of the layers in that region can be made. As described in U.S. Pat. Nos. 4,027,660, 4,077,396, 4,082,085 and 4,567,754, all to Stephen C. Wardlaw et al., and in U.S. Pat. No. 4,823,624, to Rodolfo R. Rodriguez et al., this can be achieved by inserting a precision-molded plastic float into the blood sample in the fluid tube prior to centrifugation. The float has approximately the same density as the cells in the buffy coat region, and thus becomes suspended in that region after centrifugation. Since the outer diameter of the float is only slightly less than the inner diameter of the fluid tube (typically by about 80 $\mu$m), the length of the buffy coat region will expand to make up for the significant reduction in the effective diameter of the tube that the buffy coat region can occupy due to the presence of the float. By this method, an expansion of the length of the buffy coat region by a factor between 4 and 20 can be obtained. The cell counts calculated for the components of the buffy coat region will take into account the expansion factor attributable to the float.

Another technique that is used to enhance the accuracy of the layer thickness measurements is the introduction of fluorescent dyes (in the form of dried coatings) into the fluid tube. When the blood sample is added to the fluid tube, these dyes dissolve into the sample and cause the various blood cell layers to fluoresce at different optical wavelengths when they are excited by a suitable light source. As a result, the boundaries between the layers can be discerned more easily when the layer thicknesses are measured following centrifugation.

Typically, the centrifugation step and the layer thickness measurement step are carried out at different times and in different devices. That is, the centrifugation operation is first carried out to completion in a centrifuge, and the fluid tube is then removed from the centrifuge and placed in a separate reading device so that the blood cell layer thicknesses can be measured. This added step of removing the blood tube from the centrifuge device increases the time needed to complete the layer reading process. Furthermore, because the tubes must be handled and moved between the centrifuging device and layer reading device, the likelihood that damage to the tubes will occur is increased. Additionally, because the centrifuging operation is stopped when the blood tube is being moved from the centrifuge device to the layer reading device, the blood components that have been compacted into their individual layers due to the centrifugation may begin to migrate into adjacent layers, thus resulting in inaccurate readings. Also, since the centrifuge can "spin down" multiple fluid tubes, the manual transfer to the reading device increases the chance of sample identification error.

More recently, a technique has been developed in which the layer thicknesses are calculated using a dynamic or predictive method while centrifugation is taking place. This is advantageous not only in reducing the total amount of time required for a complete blood count to be obtained, but also in allowing the entire procedure to be carried out in a single device. Apparatus and methods for implementing this technique are disclosed in the copending applications mentioned previously in the section entitled "Cross-Reference to Related Applications".

In order to allow the centrifugation and layer thickness measurement steps to be carried out simultaneously, it is necessary to "freeze" the image of the sample tube as it rotates at high speed on the centrifuge rotor. This can be accomplished by means of a xenon flash lamp assembly that produces an intense excitation pulse of light energy once per revolution of the centrifuge rotor. The pulse of light excites the dyes in the expanded buffy coat area of the sample tube, causing the dyes to fluoresce with light of known wavelengths. The emitted fluorescent light resulting from the excitation flash is focused by a high-resolution lens onto a linear array of charge-coupled devices (CCDs). The CCD array is located behind a bandpass filter which selects the specific wavelength of emitted light to be imaged onto the CCD array.

The xenon flash lamp assembly is one of two sources that are used to illuminate the fluid tube while the centrifuge rotor is in motion. The other source is an array of light-emitting diodes (LEDs) which transmit red light through the fluid tube for detection by the CCD array through a second bandpass filter. The purpose of the transmitted light is to locate the beginning and end of the plastic float (and hence the location of the expanded buffy coat area), and the fill lines of the fluid tube. Further details of the optical reading apparatus may be found in the aforementioned copending application of Bradley S. Thomas et al. entitled "Blood Centrifuge Device with Movable Optical Reader", Ser. No. 09/032,935 which issued as U.S. Pat. 6,030,086.

In order to obtain an accurate measurement of the lengths of the blood component layers, it is desirable to take several readings about the circumference of the tube. That is because, when the blood is centrifuged so that layers of the blood components are formed in the tube, it is likely that the lengths of the layers will not be uniform along the entire inner circumference of the tube. Rather, it is common for a layer to have a longer length on one side of the tube and a shorter length on the other side. Because the cell count calculations are based on the measured lengths of the layers, if the measurements are taken from only one side of the tube, it is likely that inaccurate cell counts will be calculated.

Accordingly, it is desirable to rotate the tube of centrifuged blood so that readings can be taken at various locations (e.g., 8 different locations) about the circumference of the tube. The respective readings for each layer are then averaged, so that an average length is computed for each layer. The average length for each layer is used to calculate the cell count for each respective blood component in the centrifuged blood sample, thus providing more accurate cell counts.

It is even more desirable to rotate the tube of centrifuged blood about its longitudinal axis while the tube remains in the ccentrifuge rotor, so that the readings can be taken at the various locations about the circumference of the tube without having to stop centrifugation and remove the tube from the rotor. Because no time is lost is transporting the tube of centrifuged blood from the rotor to the reading device, the overall reading time is reduced. Moreover, because less handling of the tube is required, the likelihood of damaging or misidentifying the fluid tube is also minimized.

A continuing need therefore exists for an apparatus which is capable of centrifuging a blood sample stored in a capillary tube and taking accurate measurements of the component layers of the centrifuged blood sample while allowing the capillary tube to remain in the centrifuge device. The present invention is directed to that objective.

SUMMARY OF THE INVENTION

An object of the present invention is to provide a tube rotating apparatus which is used in a centrifuge device to rotate a capillary tube, in which a blood sample being centrifuged is contained, incrementally about an axis substantially aligned with the longitudinal axis of the capillary tube, to enable the lengths of layers of the components in the centrifuged blood sample to be accurately measured without removing the capillary tube from the centrifuge apparatus.

Another object of the invention is to provide a tube rotating apparatus as described above whose rotating of the capillary tube is controlled by movement of the rotor of the centrifuge device relative to the tube rotating apparatus, thus providing a tube rotating apparatus which is simple in operation.

These and other objects of the invention are substantially achieved by providing a tube rotating apparatus, adaptable for use with a rotor of a centrifuge device, and which rotates a fluid tube, such as a capillary tube for collecting a blood sample, about a rotational axis which is in substantial alignment with the longitudinal axis of the tube while the rotor of the centrifuge device is rotating the capillary tube in a centrifuging direction. The rotating apparatus comprises a cam which is mechanically coupled to the fluid tube, and a cam follower which applies a driving force to the cam to rotate the cam, thus rotating the fluid tube about the rotational axis, while the centrifuge apparatus is rotating the fluid tube in a centrifuging direction.

The cam includes a plurality of grooves about its outer circumference which define a plurality of rotational intervals, for example, eight rotational intervals of 45° each, at which the cam is rotated by the cam follower. The cam follower can include a block assembly which is movably coupled to the rotor in a direction radial of the rotor, and urged toward a first radial position by an urging member, such as a plurality of springs or the like. When the rotational speed of the rotor is increased such that a centrifugal force is imposed on the block assembly which is sufficient to overcome the urging force imposed on the block assembly by the urging member, the centrifugal force moves the block assembly radially of the rotor to a second radial position. In doing so, the cam follower engages a groove in the cam, and thus applies a driving force to rotate the cam by one-half of a rotational interval, which in turn rotates the fluid tube about its rotational axis by one-half of a rotational interval.

When the rotational speed of the rotor is then decreased, the centrifugal force imposed on the block assembly decreases to a magnitude at which the urging member can urge the block assembly back to the first radial position. In doing so, the cam follower engages a groove in the cam, and applies a driving force to rotate the cam by another one-half of a rotational interval. Hence, by increasing and decreasing the rotational speed of the rotor to move the block assembly from the first radial position to the second radial position, and back again to the first radial position, the cam driver rotates the cam and fluid tube by one rotational interval.

A reading or multiple readings of the centrifuged sample in the fluid tube can then be taken, and the process can be repeated to rotate the cam and fluid tube by another rotational interval. The process of rotating the cam and fluid tube can be repeated, with a reading or multiple readings of the centrifuged sample in the fluid tube being taken at every rotational interval, until the cam and fluid tube have been rotated through a full rotation, or by any desired number of rotational intervals.

BRIEF DESCRIPTION OF THE DRAWINGS

These and other objects, advantages and novel features of the invention will be more readily appreciated from the following detailed description when read in conjunction with the accompanying drawings, in which.

DETAILED DESCRIPTION OF THE PREFERRED EMBODIMENTS

Figure 1:
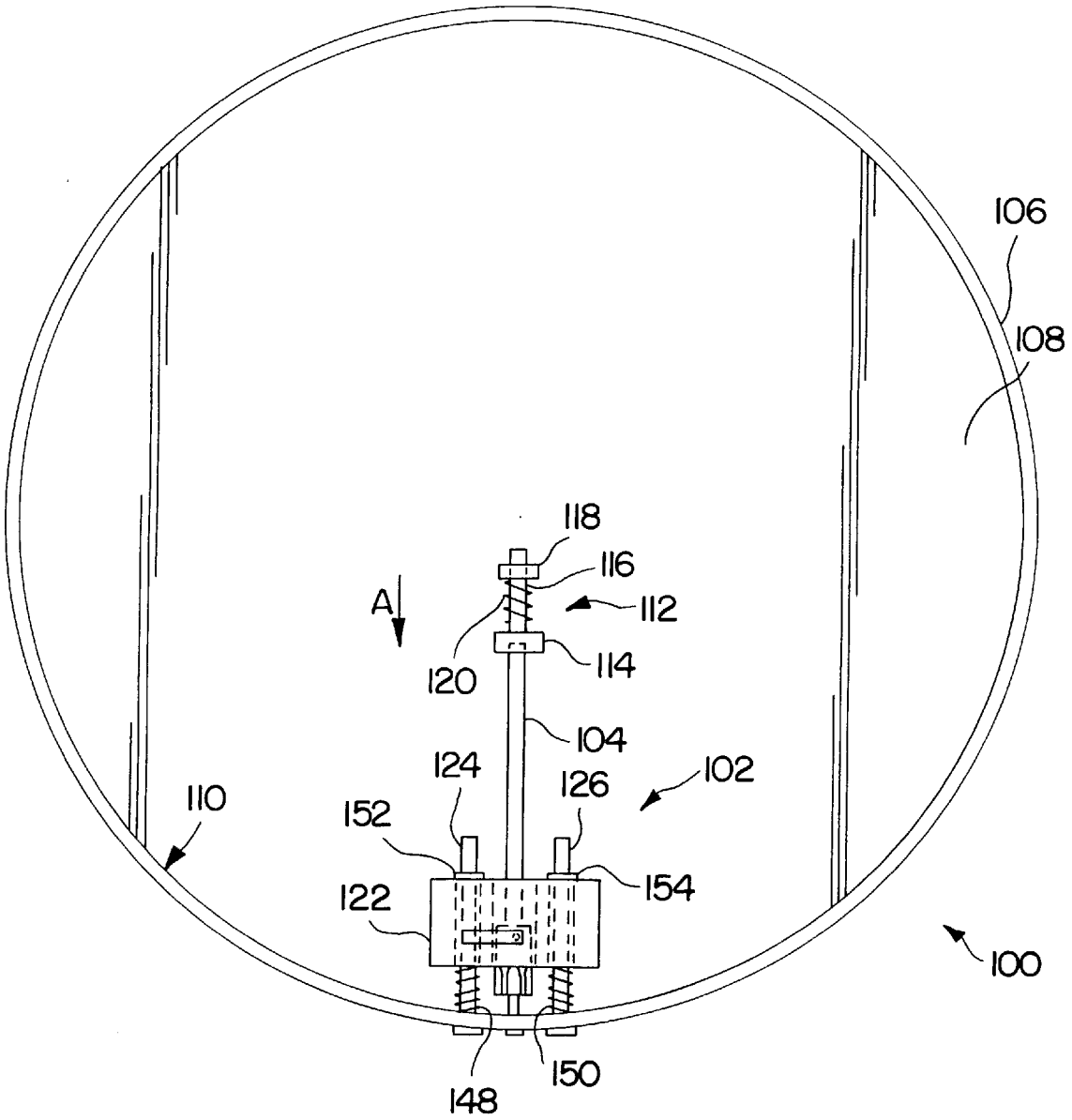
FIG. 1 is a top plan view of a blood centrifuge rotor assembly in which a tube rotating apparatus according to an embodiment of the present invention is employed.

A rotor assembly 100 in which a tube rotator assembly 102 according to an embodiment of the present invention is employed is shown in FIG. 1. The rotor assembly 100 can be included in a centrifuge apparatus (not shown), such as that described in the aforementioned copending U.S. patent application of Michael R. Walters entitled "Inertial Tube Indexer and Method for Using the Same", Ser. No. 09/032,931, and in the aforementioned copending U.S. patent application of Bradley S. Thomas et al. entitled "Blood Centrifugation Device with Movable Optical Reader", Ser. No. 09/033,368, to centrifuge a blood or other fluid sample that has been collected in a fluid tube 104, such as the type described in the Background section above.

The rotor assembly 100 includes a rotor 106, which can be made of metal, composite material, or any other suitable material, having a planar or substantially planar surface 108 and an edge 110 which extends along the circumference of the rotor 106 upwardly from the planar surface 108. The rotor assembly 100 further includes a tube receiving apparatus 112 which is adapted to receive one end of a fluid tube 104 which is loaded in the rotor assembly 100.

The tube receiving apparatus 112 includes a receptacle 114 having a recess therein into which is received one end of the fluid tube 104. Receptacle 114 can include a rubber washer or any other suitable component which assists in holding the end of fluid tube 104 in the receptacle 114. Receptacle 114 is connected to a shaft 116, which is slidably and rotatably mounted to a shaft mounting block 118 that is integral with or mechanically coupled to the planar surface 108 of the rotor 106. A spring 120 is fitted over the shaft 116, so that one end of the spring 120 contacts the receptacle 114 and the other end of the spring 120 contacts shaft mounting block 118. Accordingly, the spring 120 urges the receptacle 114 in the direction indicated by arrow A to secure the fluid tube 104 in a manner described in more detail below. Further details of a rotor 106 and tube receiving apparatus 112 of the type described above can be found in copending U.S. patent application Ser. Nos. 09/032,931 and 09/033,368, cited above.

Figure 2:
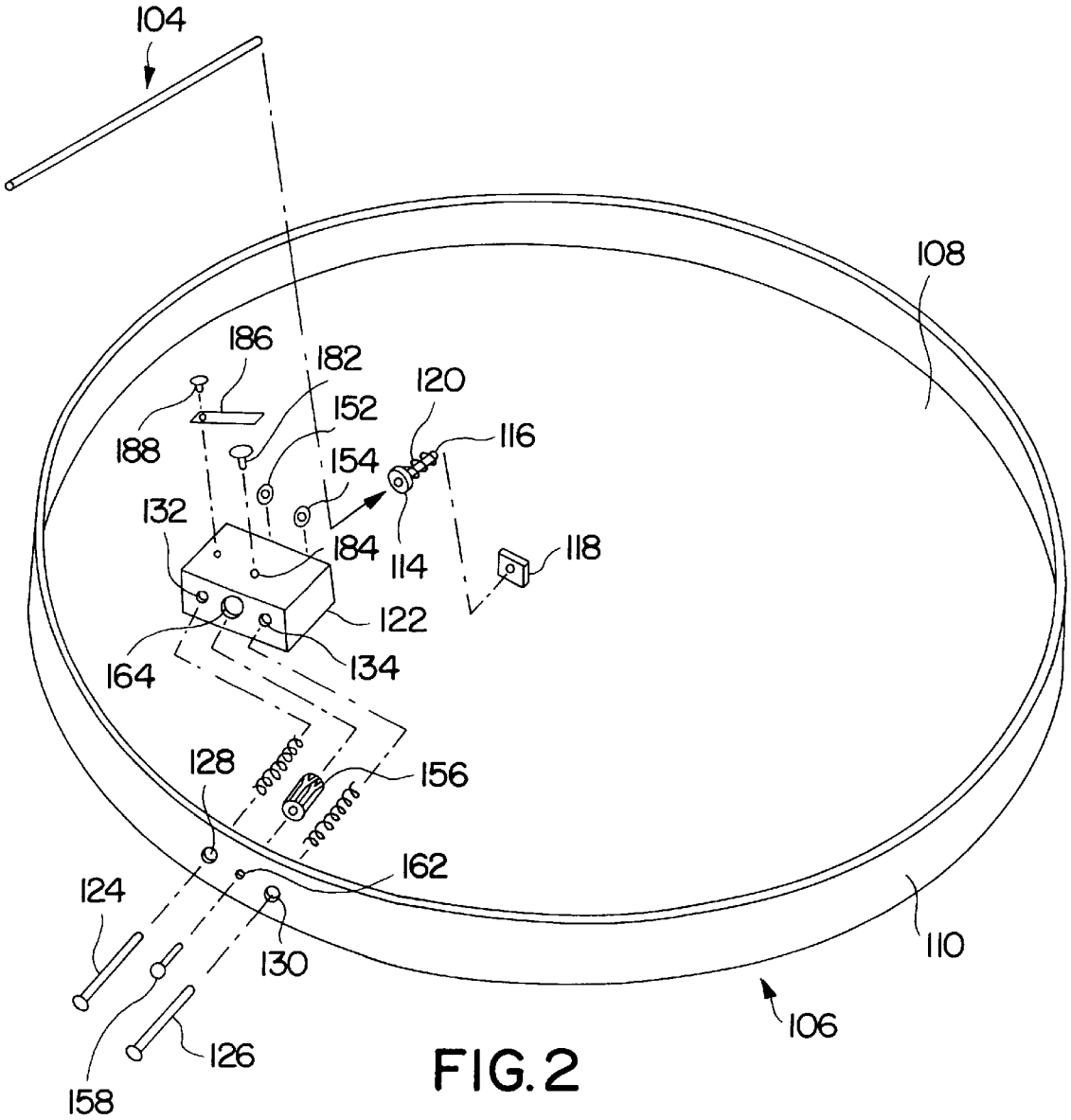
FIG. 2 is an exploded perspective view of the rotor assembly and tube rotating apparatus shown in FIG. 1.
Figure 3:
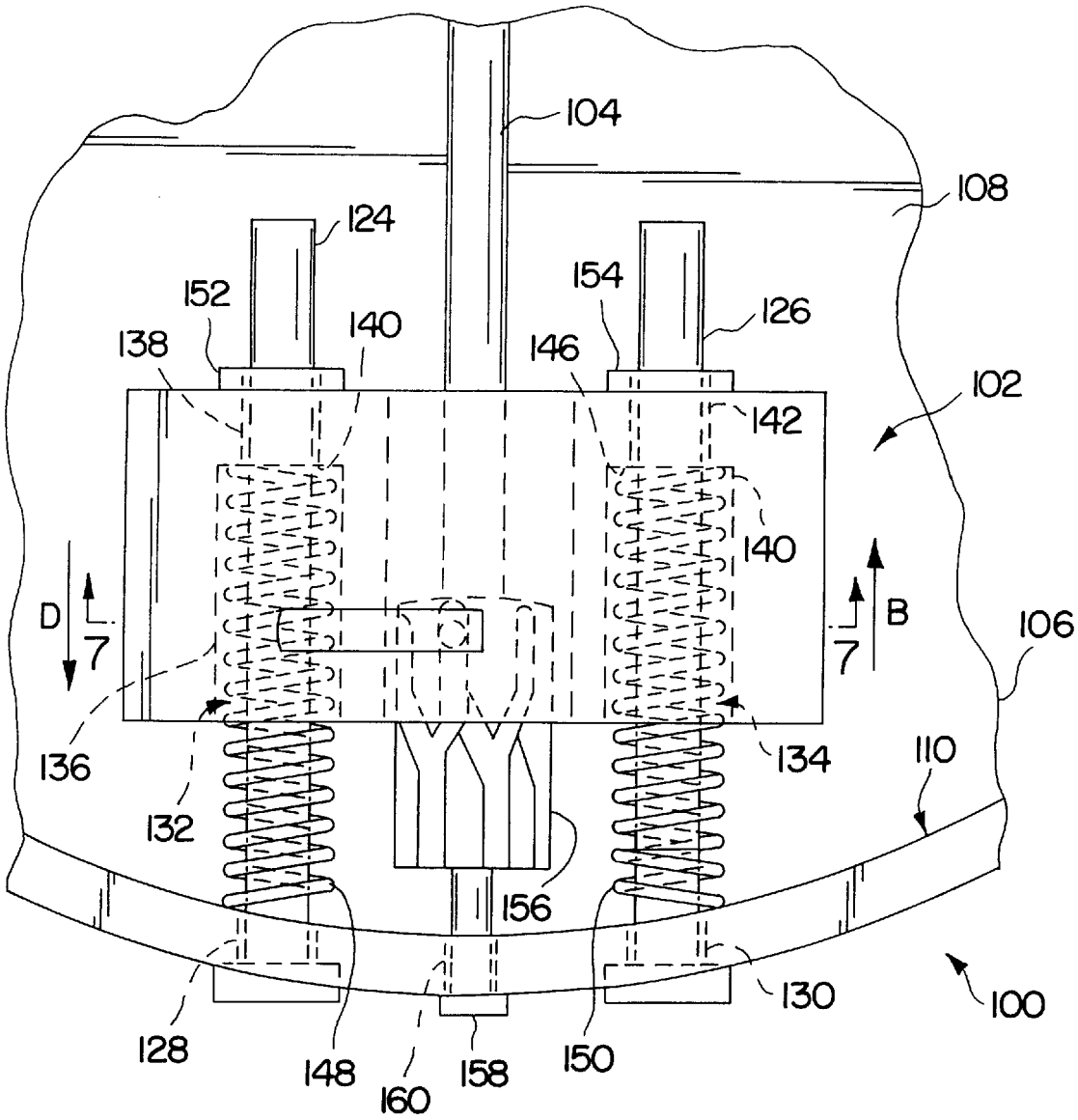
FIG. 3 is a detailed view of the tube rotating apparatus shown in FIG. 1.

As shown in FIG. 1 and in more detail in FIGS. 2 and 3, the tube rotator assembly 102 includes a block 122 which is slidably coupled to the edge 110 of rotor 106 by block pins 124 and 126. That is, block pins 124 and 126 pass through openings 128 and 130 in the edge 110 of rotor 106, and through block openings 132 and 134 in block 122. Block opening 132 has a large diameter portion 136 and a small diameter portion 138 which form a step portion 140 therebetween, and block opening 134 also has a large diameter portion 142 and a small diameter portion 144 which form a step portion 146 therebetween.

Springs 148 and 150 are fitted about block pins 124 and 126 before block pins 124 and 126 are inserted into openings 132 and 134, respectively, but after pins 124 and 126 have passed through openings 128 and 130, respectively. Hence, springs 148 and 150 are maintained between the inner surface of edge 110 and their respective step portions 140 and 146, and urge block 122 in a direction indicated by arrow B in FIG. 3 for purposes described in more detail below. Fasteners 152 and 154 are coupled to block pins 124 and 126, respectively, and prevent block 122 from traveling off the distal ends of block pins 124 and 126.

Tube rotator assembly 102 further includes a cylindrical cam 156 which is rotatably coupled to edge 110 of rotor 106 by a cam pin 158 as shown. Cam pin 158 passes through opening 160 in edge 110, and is received into opening 162 of cam 156. Cam pin 158 is rotatable with respect to edge 110, thus enabling cam 156 to rotate in the manner described below.

Cam 156 is received into a cam opening 164 in block 122 when block 122 is secured to the edge 110 of rotor 106 by block pins 124 and 126 as described above. Cam 156 is enable to rotate freely in cam opening 164, which passes entirely through block 122 as shown. The end of cam 156 opposite to that into which cam pin 158 is received includes or is attached to a tube receptacle 166. Tube receptacle 166 includes an opening for receiving the end of fluid tube 104 opposite to the end which is received in receptacle 114 as described above. Like receptacle 114, tube receptacle 166 can include a rubber washer or any other suitable component which assists in holding the end of fluid tube 104 in the receptacle 166. Although receptacles 114 and 166 are shown as receiving a capillary-type fluid tube 104, fluid tube 104 can also be a carrier tube of the type described in the aforementioned copending U.S. patent application of Edward G. King et al. entitled "Disposable Blood Tube Holder and Method for Using the Same", Ser. No. 09/033,373.

Cam 156 further includes a cam groove pattern 168 disposed about its circumference. As shown in more detail in FIG. 4, the cam groove pattern includes a plurality of first longitudinal groove sections 170-1, 170-2 through 170-n disposed at equal intervals about the circumference of cam 156, and a plurality of second longitudinal groove sections 172-1, 172-2 through 172-n disposed at equal intervals about the circumference of cam 156. The first groove sections and second groove sections are staggered on offset with regard to each other about the circumference of the cam 156 as shown. In this example, cam 156 includes eight first groove sections 170-1 through 170-8, which are disposed at 45° intervals about the circumference of cam 156. Cam 156 also includes eight second groove sections 172-1 through 172-8, which are disposed at 45° intervals about the circumference of cam 156. In this example, cam 156 has an overall length of about 0.685 inches and an overall diameter of about 0.500 inches. Also, the width of each of the first groove sections 170-1 through 170-8 and of each of the second groove sections 172-1 through 172-8 is about 0.067 inches at the outer surface of the cam 156, and each of the first groove sections 170-1 through 170-8 and second groove sections 172-1 through 172-8 have a maximum depth of about 0.050 inches measured radially to the outer surface of the cam 156.

Figure 4:
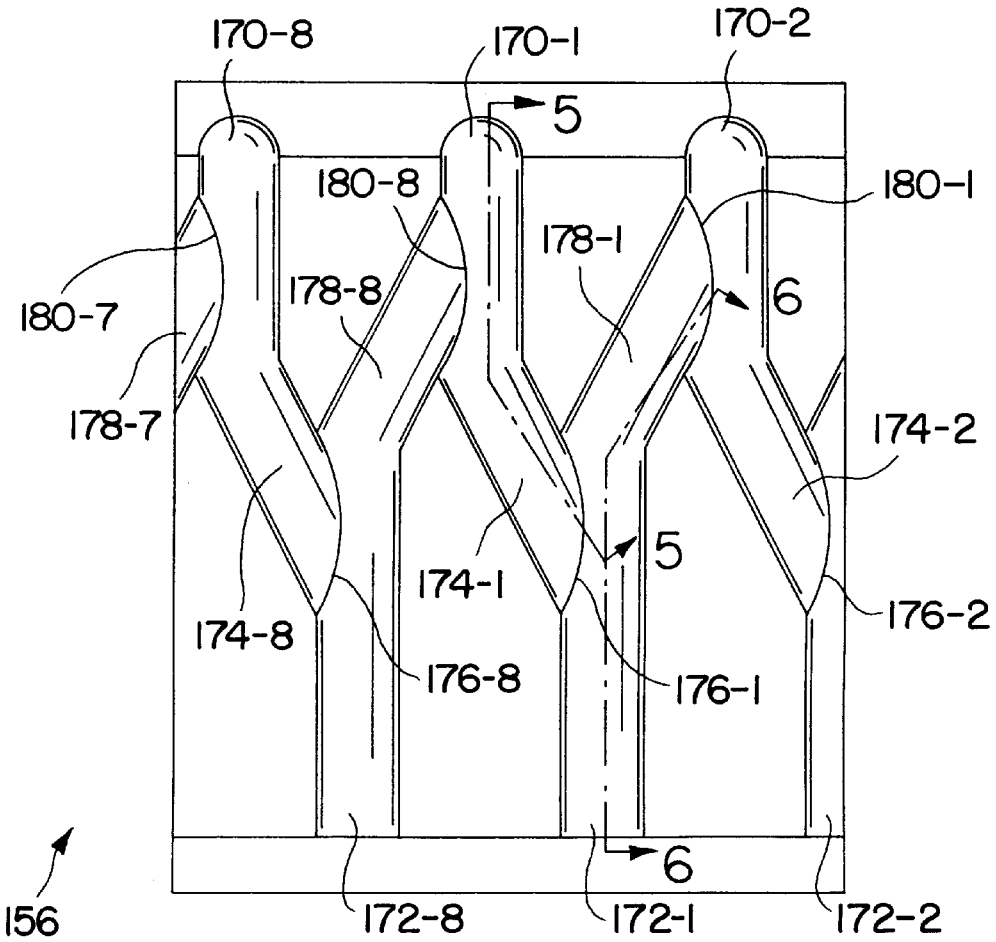
FIG. 4 is a top plan view of a cam used in the tube rotating apparatus shown in FIG. 1.
Figure 5:
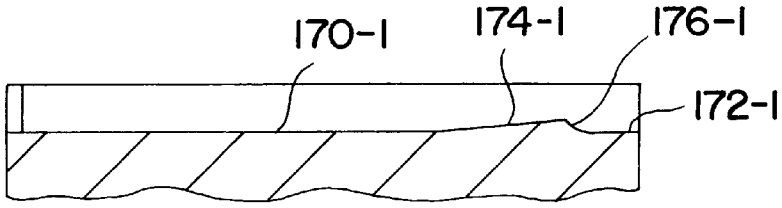
FIG. 5 is a detailed cross-sectional view of the cam taken along line 5—5 in FIG. 4.
Figure 6:
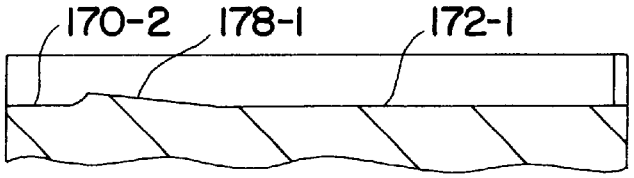
FIG. 6 is a detailed cross-sectional view of the cam taken along line 6—6 in FIG. 4.

As shown in FIGS. 4 and 5, each first groove section 170-1 through 170-8 has a raised portion 176-1 through 176-8, respectively, creating steps 176-1 through 176-8 between the first groove sections 170-1 through 170-8 and their adjacent second groove sections 172-1 through 172-8, respectively. The purpose of these steps is described in more detail below. As shown in FIGS. 4 and 6, each second groove section 172-1 through 172-8 has a raised portion 178-1 through 178-8, respectively, creating steps 180-1 through 180-8 between the second groove sections 172-1 through 172-8 and their adjacent first groove sections 170-2 through 172-1, respectively, again, the purpose of these steps is described in more detail below.

Figure 7:
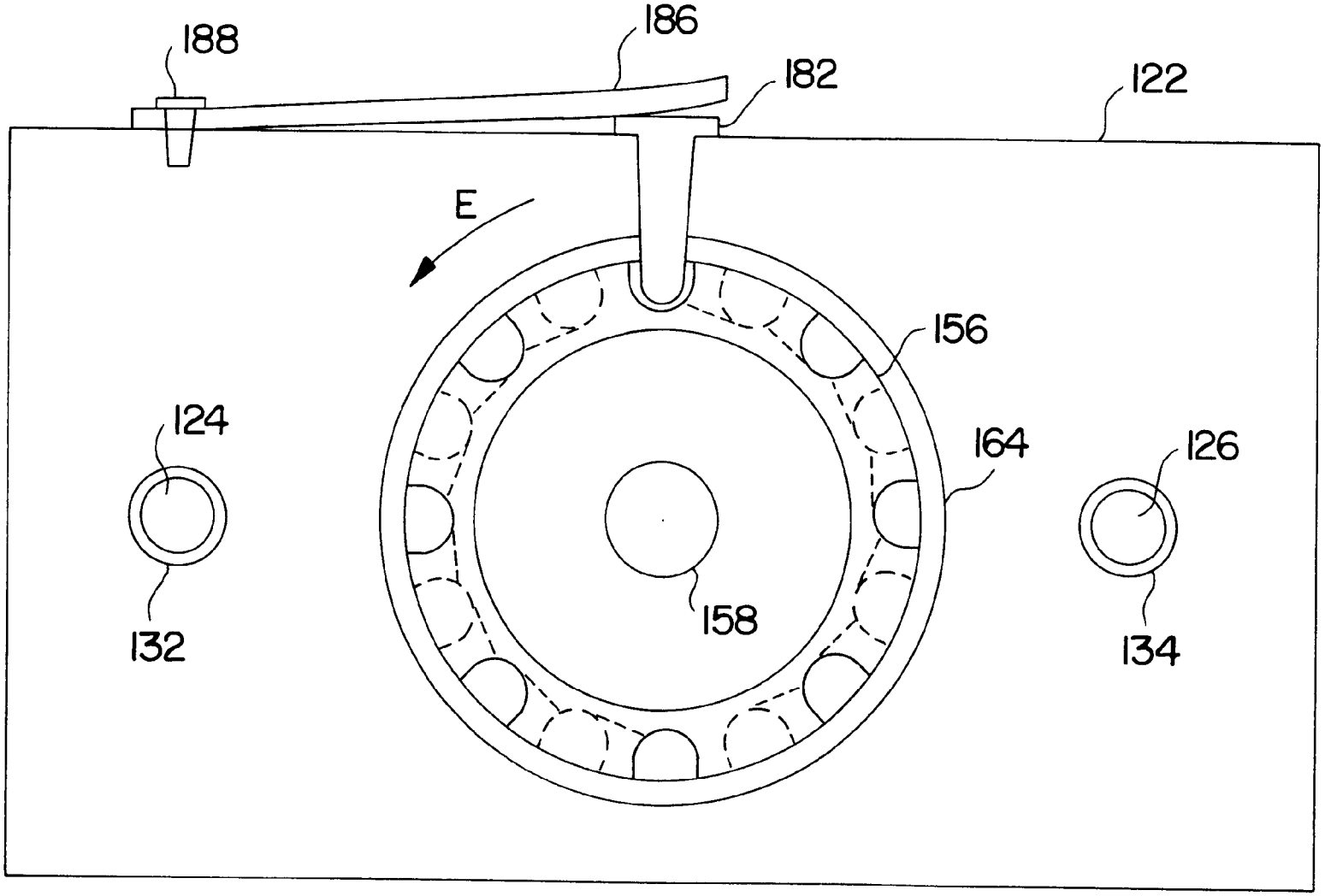
FIG. 7 is a detailed cross-sectional view of the cam and block of the tube rotating apparatus as taken along line 7—7 in FIG. 3.

Tube rotator assembly 102 further includes a cam follower 182, which can be a pin, rivet, or the like having a shaft as shown, for example, in FIG. 2. The shaft of cam follower 182 passes through a cam follower opening 184 in block 122, which opens into cam opening 164 in block 122. A resilient member 186, such as a leaf spring or the like, is attached to block 122 by a screw 188, rivet, or any suitable member, to resiliently secure cam follower 182 in cam follower opening 184 as shown. Resilient member 186 permits cam follower 182 to slide radially of the cam 156 for purposes described in detail below. As shown schematically in FIG. 7, cam follower 182 is received in groove pattern 168 of cam 156, and thus follows groove pattern 168 in the manner described below.

As discussed above, rotor assembly 100 can be employed in a centrifuge apparatus (not shown), such as those described in copending U.S. patent application Ser. Nos. 09/032,931 and 09/033,368, cited above. In such an apparatus, as shown schematically in FIG. 8, rotor assembly 100 is rotated about its central axis by a motor 190 whose drive shaft is coupled to the rotor assembly 100, and which is controlled by a computer or central processing unit (CPU) 192.

Figure 8:
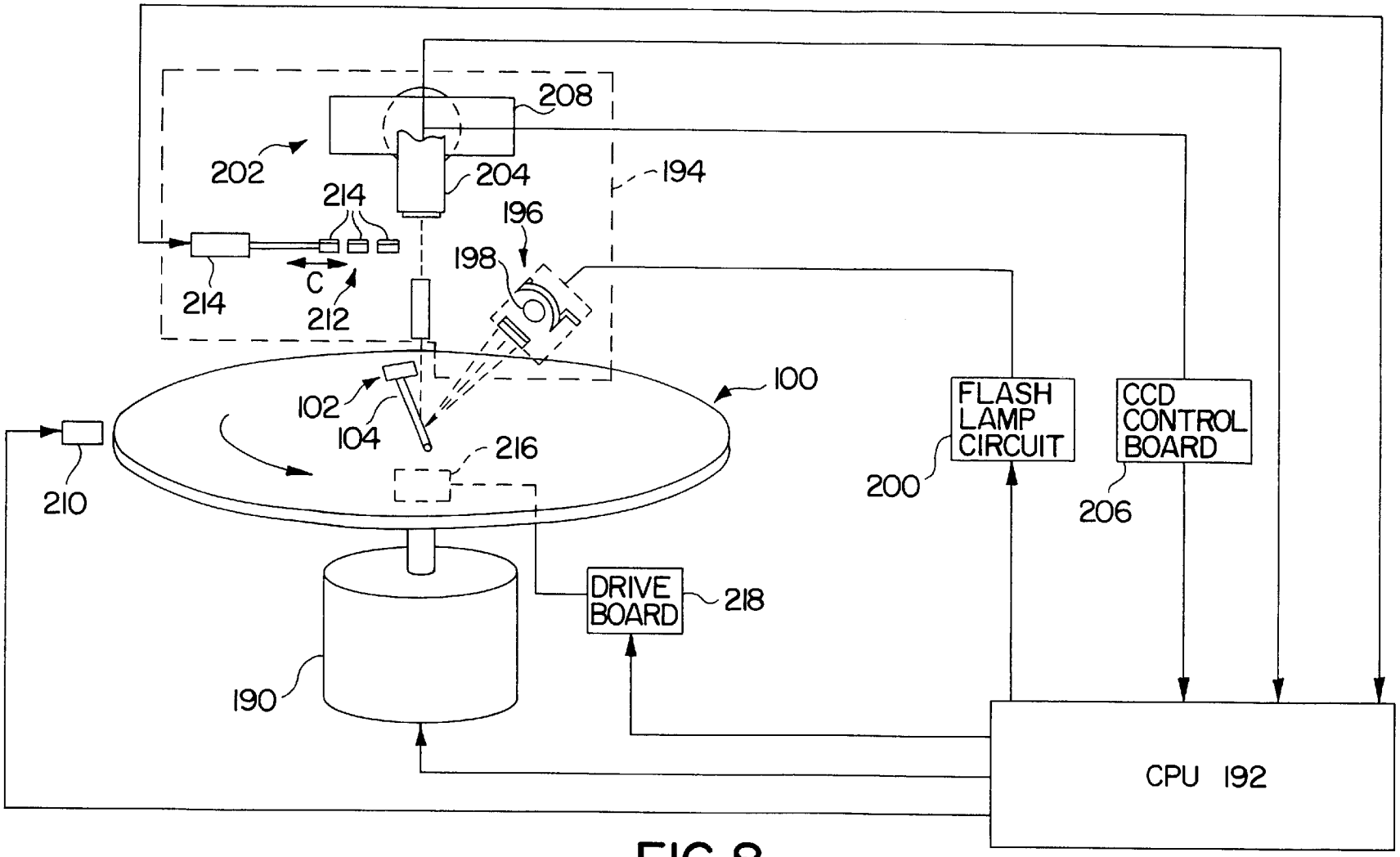
FIG. 8 is a schematic view of the components of an exemplary blood centrifuge apparatus in which the rotor assembly shown in FIG. 1 can be employed.

As further illustrated, in FIG. 8, the centrifuge apparatus further includes an optical carriage assembly 194 that includes a flash tube assembly 196 having a flash tube 198 that is energized by a flash lamp circuit 200 as controlled by the CPU 192. The optical carriage assembly 194 further includes a CCD array assembly 202 having a CCD array 204. The CCD array 204 is controlled by a CCD control board 206 that is controlled by CPU 192 to operate in cooperation with flash tube 198, so that when flash tube 198 is driven to emit light toward the fluid tube 104 loaded in the rotor assembly 100, the CCD array 204 is controlled to detect light that is produced or reflected by the contents (e.g., a blood fluid) of the fluid tube 104 in response to the light emitted by the flash tube 198.

The optical carriage assembly 194 further includes an optics transport motor 208 which controls the movement of the optical carriage assembly 194 and, in particular, the movement of the CCD array assembly 202, along guide rails (not shown) in a direction radial of the rotor assembly 100. The optics transport motor 208 is controlled by CPU 192 to move the optical carriage assembly 194 in this manner so that the CCD array 204 can read the entire sample contained in the fluid tube 104.

The centrifuge apparatus also includes a rotor assembly orientation sensor 210 which, as described in more detail below, senses when the rotor assembly 100 is oriented such that the fluid tube 104 is positioned below the CCD array 204, and provides a signal to CPU 192. When the CPU 192 receives the signal from the rotor assembly orientation sensor 210, the CPU 192 controls the flash lamp circuit 200 to drive the flash tube 198, and controls the CCD control board 206 to control the CCD array 204 to read the light emitted from the sample in the fluid tube 104.

The optical carriage assembly 194 further includes a filter rack 212 which is driven by a filter motor 214 to move in a direction indicated by arrow C in FIG. 8, so that each of the individual filters of the filter rack 212 can be positioned in front of the CCD array 204 as desired. Each filter 214 in the filter rack 212 is capable of filtering out light having particular wavelengths from the light being emitted by the sample in fluid tube 104, while allowing light of a desired wavelength to pass to the CCD array 204.

Additionally, the centrifuge apparatus 100 includes an LED bar 216 which is disposed below the rotor assembly 100 and is controlled by CPU 192 via the drive board 218 to emit light in the direction of rotor assembly 100. This light passes through slits (not shown) in the rotor assembly 100, and is detected by CCD array 204 as the rotor assembly 100 rotates, to ascertain the presence and absence of a fluid tube 104 in the rotor assembly 100.

These and other features of a centrifuge apparatus in which the rotor assembly 100 can be employed, as well as the operation of the centrifuge apparatus as a whole, are described in more detail in the aforementioned copending U.S. patent application Ser. Nos. 09/032,931 and 09/033,368, cited above, and in aforementioned copending U.S. patent application of Bradley S. Thomas entitled "Flash Tube Reflector with Arc Guide", Ser. No. 09/032,935.

The operation of tube rotator assembly 102 will now be described. When a fluid tube 104 is ready for loading into the centrifuge apparatus, the CPU 192 controls the motor 190 to rotate the rotor assembly 100 to the proper orientation for loading of the fluid tube 104, as determined through the use of the rotor assembly orientation sensor 210 as described above. The fluid tube 104 is then loaded into the rotor assembly 100 by placing one end of fluid tube 104 into receptacle 114, and the other end of fluid tube 104 into receptacle 166. As discussed above, the shaft 116 attached to receptacle 114 can be slid backward in the opening in shaft mounting block 118 in order to load the fluid tube 104, and spring 120 urges receptacle 114 toward receptacle 166 so that the fluid tube 104 is firmly held between the receptacles 114 and 166. A rubber washer or the like in the receptacles 114 and 166 functions to hold the ends of the tube 104 in the receptacles 114 and 166 as discussed above.

After the fluid tube 104 containing the fluid (e.g., uncoagulated blood) to be centrifuged is loaded into the rotor assembly 100 in the manner described above, the centrifuge apparatus can begin to centrifuge the sample to separate the components of the sample into individual layers. The CPU 192 controls the motor 190 to rotate the rotor assembly 100 at a suitable centrifuging speed, which is typically about 8,000 r.p.m. to about 12,000 r.p.m. After the sample has been centrifuged for the appropriate amount of time, which is typically about 3 to 5 minutes, the centrifuged sample in the capillary tube can be read by the optics in the optical carriage assembly 194 as described in copending U.S. patent application Ser. Nos. 09/032,931 and 09/033,368, cited above. The CPU 192 will typically decrease the rotation speed of the rotor assembly 100 to a suitable speed for reading, which is usually about 1,000–2,500 r.p.m. However, the centrifuging speed and the reading speed can be varied as necessary to suit the requirements of particular applications.

Also, as can be appreciated from the following, when the rotor assembly 100 is rotated at the centrifuging speed, block 122 is moved by centrifugal force in the direction of arrow D in FIG. 3 until it abuts against the inner surface of the edge 110 of rotor 106. Block 122 remains abutted against the edge 110 of the rotor 106 until the speed of rotation of the rotor 106 is decreased to a level at which the centrifugal force imposed on block 122 decreases to a magnitude at which the force imposed on block 122 by springs 148 and 150 moves block 122 in the direction of arrow B in FIG. 3 back to its original position. This movement of block 122 results in the fluid tube 104 being rotated or "indexed" by one indexing increment, as will now be described.

After the appropriate number of readings have been taken of the sample by the CCD array 204 of the optical carriage assembly 194 when the fluid tube 104 is in its initial reading orientation in the rotor assembly 100 (i.e., after the initial "indexing" has been performed when the speed of the rotor 106 is increased for centrifugation and decreased for reading as described above), the CPU 192 will control the motor in such a manner that the tube rotator assembly 102 rotates the fluid tube 104 incrementally about its longitudinal axis so that readings of the sample can be taken from different locations about the circumference of the fluid tube 104. As described above in the Background section, it is desirable to take sample readings at different locations about the circumference of the fluid tube 104 (i.e., with the fluid tube 104 at different orientations about its longitudinal axis) to obtain more accurate measurements of the lengths of the layers in the centrifuged blood sample. The CPU 192 will therefore control the tube rotator assembly 102 to perform this incremental rotation or "indexing" of the fluid tube 104 by changing the rotational speed of the motor 190.

Specifically, during reading, the motor 190 normally rotates the rotor assembly 100 in a given direction (e.g., counterclockwise) at a suitable speed as discussed above. At this rotational speed, the centrifugal force imposed on block 122 by the rotation of rotor assembly 100 in the direction indicated by arrow D in FIG. 3 is insufficient to overcome the force imposed on block 122 by springs 148 and 150 in the direction of arrow B in FIG. 3. Accordingly, block 122 remains positioned with respect to cam 156 as indicated in FIG. 3, with the cam follower 182 being positioned in the groove pattern 168 the solid line position shown in FIG. 9. That is, cam follower 182 remains near the proximal end of one of the first groove sections (in this example, first groove section 170-1). A reading or multiple readings of the centrifuged sample in the fluid tube 104 can be taken, if desired, before any rotating or "indexing" of the fluid tube 104 is performed for reading purposes.

When it becomes appropriate to rotate or "index" fluid tube 104 about its longitudinal axis, CPU 192 controls motor 190 to increase its rotational speed, which in turn increases the rotational speed of the rotor assembly 100. This increased rotational speed of the rotor assembly 102 imposes a greater centrifugal force on block 122 in the direction of arrow D in FIG. 3. Once the rotational speed becomes large enough, the centrifugal force imposed on block 122 overcomes the force imposed on block 122 by springs 148 and 150, and moves block 122 along block pins 124 and 126 in the direction indicated by arrow D.

The rotational speed at which the spring force is overcome can be any suitable speed, such as 8,000–10,000 r.p.m., or more or less, and is dependent on the mass of block 122 and the spring force of springs 148 and 150. That is, by decreasing the spring force of springs 148 and 150, increasing the mass of block 122, or both, the rotational speed at which the centrifugal force overcomes the spring force is decreased. Alternatively, by increasing the spring force of springs 148 and 150, decreasing the mass of block 122, or both, the rotational speed at which the centrifugal force overcomes the spring force is increased.

Figure 9:
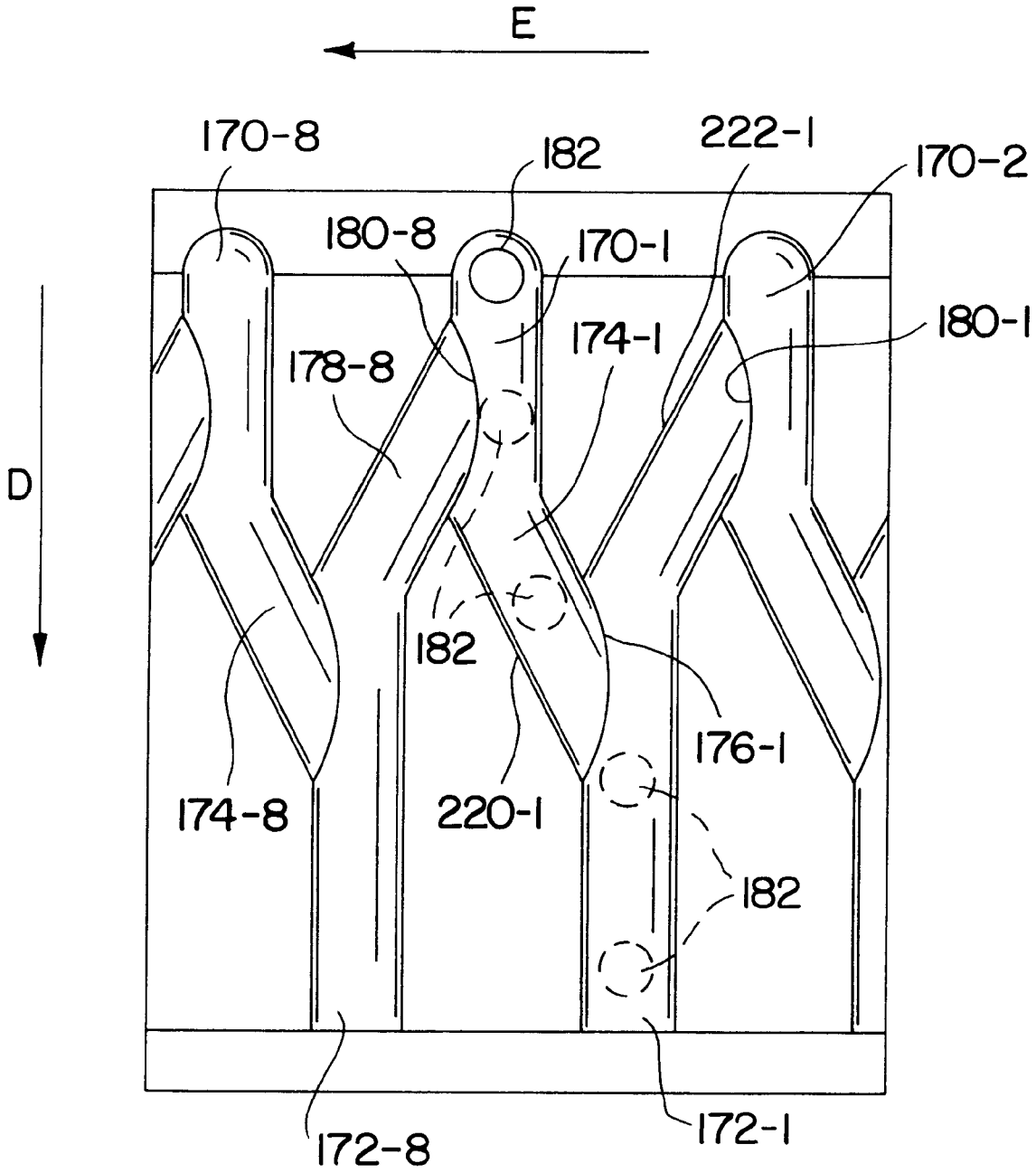
FIGS. 9 and 10 are detailed views illustrating movement of the cam follower and cam in response to movement of the block of the tube rotating apparatus shown in FIG. 1.

When block 122 moves in the direction indicated by arrow D, cam follower 182 also moves in the direction of arrow D. As shown in FIG. 9, when cam follower 182 moves in the direction of arrow D in first groove section 170-1, it abuts against step 180-8 as shown in dashed line. Step 180-8 prevents cam follower 182 from entering second groove section 172-8, and directs cam follower to follow wall 220-1 forming a portion of first groove section 170-1.

Cam follower 182 is mounted in block 122, and is thus prevented from moving in a direction transverse of arrow D. Hence, cam follower 182 imposes a force on step 180-8, and subsequently on the wall 220-1. Because cam 156 is rotatable about cam pin 158 as described above, the force imposed on step 180-8 and wall 220-1 by cam follower 182 is translated into a rotational force which rotates cam 156 in the direction indicated by arrow E in FIGS. 7 and 9. This rotation of cam 156 allows cam follower 182 to follow first groove section 170-1 into second groove section 172-1, where it becomes positioned as shown in dashed lines in FIG. 9 and by solid line in FIG. 10. Because resilient member 186 allows cam follower 182 to deflect radially of the cam 156, cam follower 182 can travel along raised portion 174-1 essentially without restriction. As cam follower 182 follows raised portion 174-1 of first groove portion 170-1 and passes over step 176-1 into second groove section 172-1, the cam 156 is thus rotated by 22.5°, which is one-half of the spacing interval between adjacent first groove sections 170-1 and 170-2, which in this example is 45°. Accordingly, the cam 156 rotates fluid tube 104 by 22.5° about its longitudinal axis.

To rotate the fluid tube 104 by one complete indexing increment which, in this example, is 45°, the CPU 192 next slows the speed of rotation of motor 190 and thus, the rotation of rotor assembly 100, down to a speed at which reading is performed (about 1,000–2,500 r.p.m. in this example). When this occurs, the centrifugal force imposed on block 122 due to the rotation of rotor assembly 100 decreases to a level at which it is overcome by the force imposed on block 122 by springs 148 and 150. When this occurs, the spring force urges block 122 in the direction indicated by arrow B in FIGS. 3 and 10.

Figure 10:
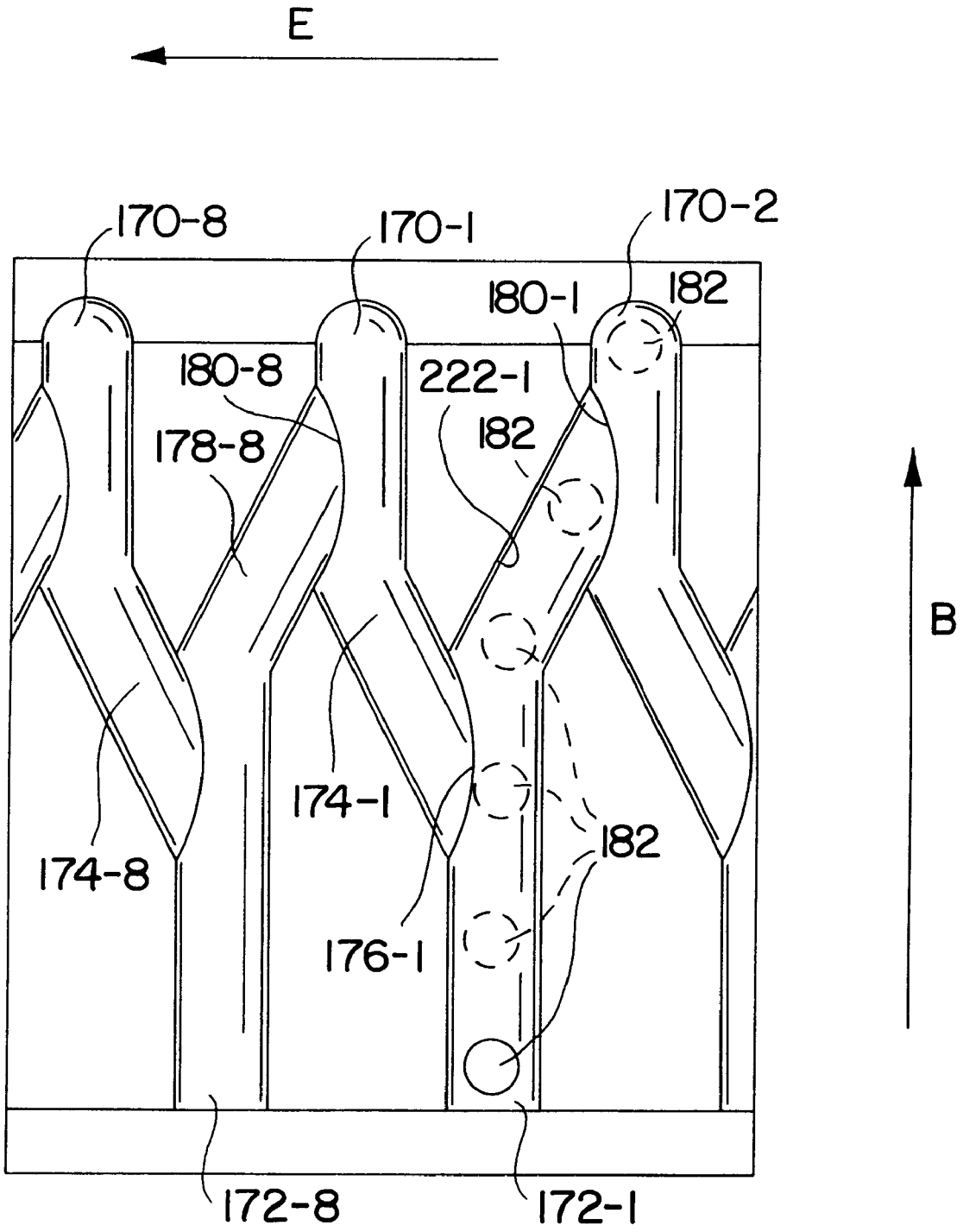

When block 122 moves in the direction indicated by arrow B, cam follower 182 also moves in the direction of arrow B. As shown in FIG. 10, when cam follower 182 moves in the direction of arrow B in second groove section 172-1, it abuts against step 176-1 as shown in dashed lines. Step 176-1 prevents cam follower 182 from entering first groove section 170-1, and directs cam follower 182 to follow wall 222-1 forming a portion of second groove section 172-1.

Cam follower 182 is mounted in block 122, and is thus prevented from moving in a direction transverse of arrow B. Hence, cam follower 182 imposes a force on step 176-1, and subsequently on wall 222-1. Because cam 156 is rotatable about cam pin 158 as described above, the force imposed on step 176-1 and wall 222-1 by cam follower 182 is translated into a rotational force which rotates cam 156 in the direction indicated by arrow E in FIG. 10. This rotation of cam 156 allows cam follower 182 to follow second groove section 172-1 into first groove section 170-2, where it becomes positioned as shown in dotted line in FIG. 10. As cam follower 182 follows raised portion 178-1 of second groove portion 172-1 and passes over step 180-1 into first groove section 172-2, the cam 156 is thus rotated by 22.5°, which is one-half of the interval spacing between adjacent first groove sections 170-1 and 170-2, which in this example is 45°. Accordingly, the cam 156 rotates fluid tube 104 by another 22.5° about its longitudinal axis.

After completion of the above operation, cam follower 182 has moved from the distal end of first groove section 170-1 to the distal end of first groove section 170-2, and cam 156 and fluid tube 104 have been rotated about their respectively longitudinal axes by 45°, which in this example is one indexing increment. Readings of the centrifuged sample contained in fluid tube 104 can then be taken with the fluid tube 104 in this new orientation in the manner described above.

After all readings at this orientation have been taken, the above indexing process can be repeated to index the fluid tube 104 by six additional indexing increments if readings were taken prior to any indexing being performed for reading purposes (i.e., not counting the initial indexing that occurs when the rotor speed is increased to centrifuge the sample, and then decreased to the reading speed), with readings being taken after each indexing increment. That is, if readings were taken before any indexing was performed for reading purposes, the indexing is performed a total of seven times, with the fluid tube 104 being rotated a total of 315° from the position at which the first readings were taken. However, if no readings were taken before the first indexing for reading purposes is performed, the indexing is performed a total of eight times, with the fluid tube 104 being rotated a total of 360° from the position prior to indexing for reading, and the last readings being taken after the fluid tube 104 has been indexed the eighth time.

Figure 11:
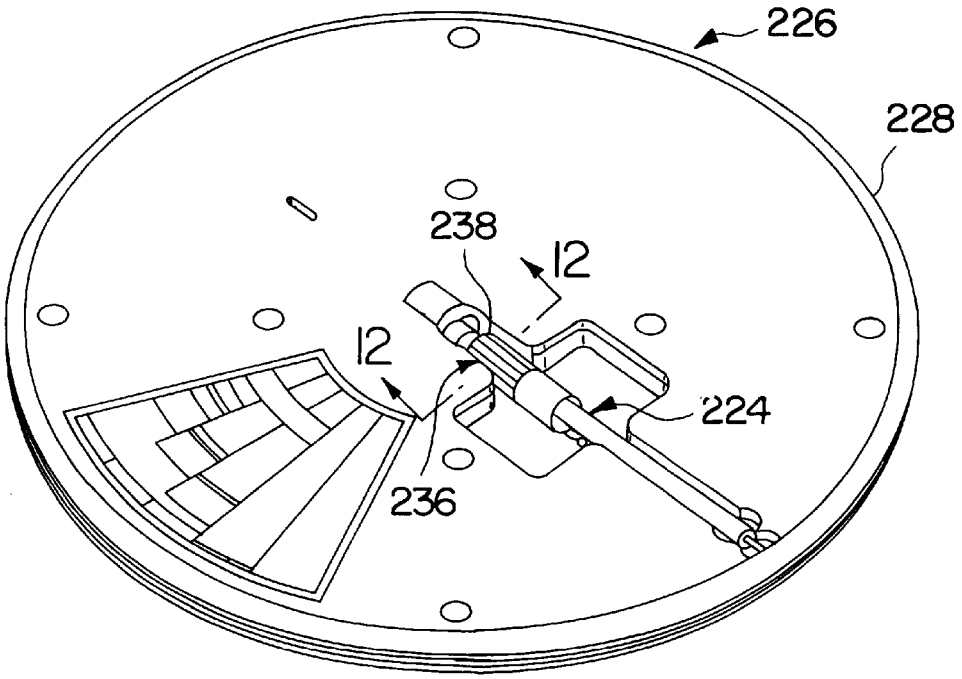
FIG. 11 is a perspective view of a rotor assembly including a tube rotating apparatus according to another embodiment of the present invention.
Figure 12:
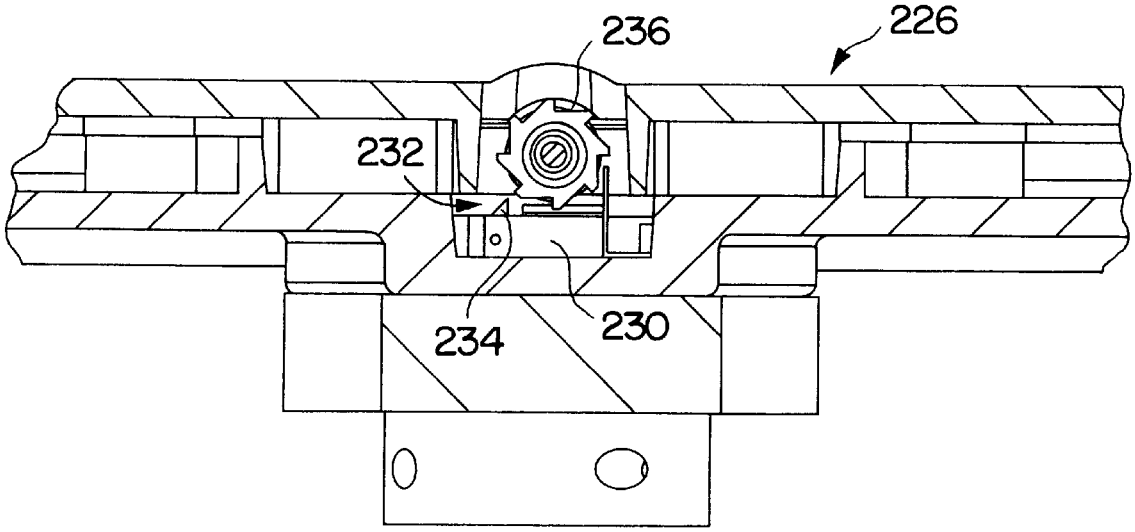
FIG. 12 is a detailed cross-sectional view taken along line 12—12 in FIG. 11.

The tube rotator assembly 102 is not limited to the configuration described above. For example, as shown in FIGS. 11 and 12, the tube rotator assembly can be configured as an indexing apparatus which rotates a fluid tube in the form of a carrier tube 224 as described in copending U.S. patent application Ser. No. 09/033,37 cited above. The carrier tube 224 includes a fluid tube therein which contains a sample to be centrifuged. In this example, rotor assembly 226 includes a rotor 228 and a hub assembly 230 which couples the rotor assembly 226 to the shaft of the motor 190, and is also rotatable in a restricted manner with respect to the rotor 228. The hub assembly 230 includes the indexing apparatus 232, which comprises a pivotable member 234 that is adapted to engage a gear 236 present on the cap 238 of carrier tube 224.

Figure 13:
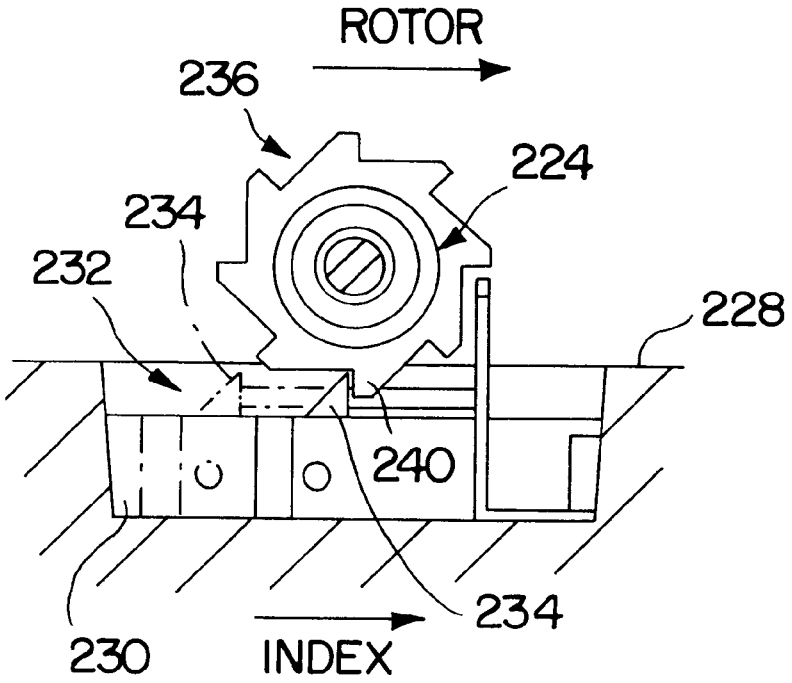
FIGS. 13–17 are detailed views illustrating rotation of a carrier tube as effected by the tube rotating apparatus of the rotor assembly shown in FIG. 11.
Figure 14:
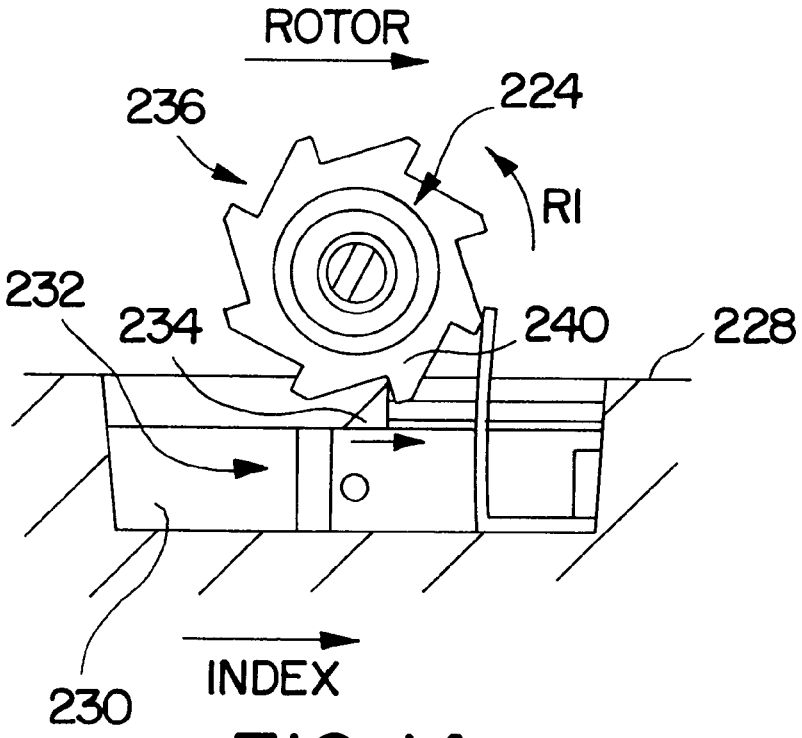
Figure 15:
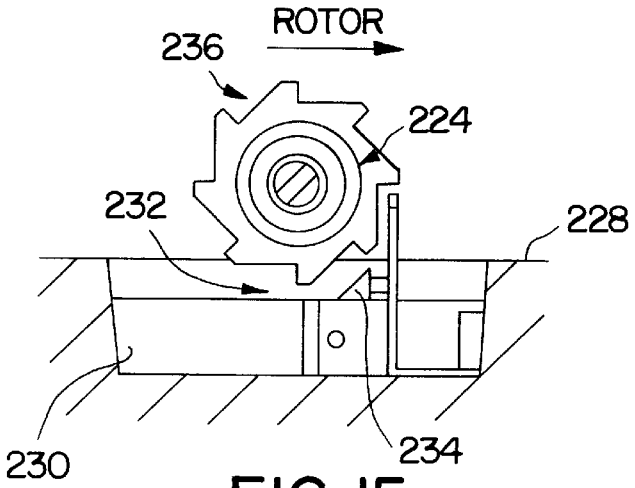
Figure 16:
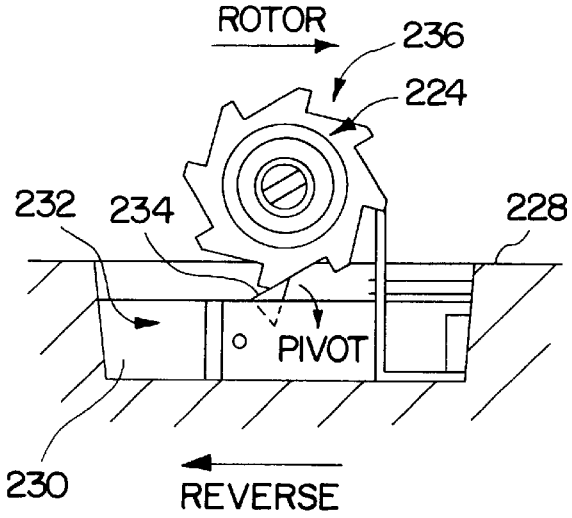
Figure 17:
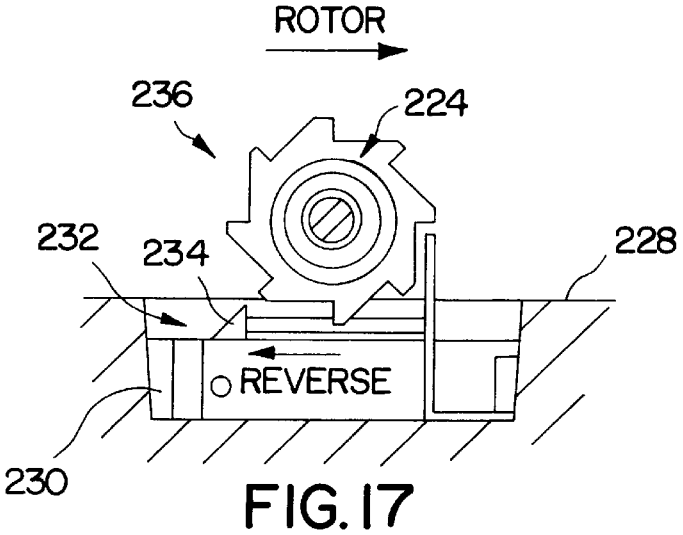

During normal rotation of the rotor assembly 226, the hub assembly 230 and rotor 228 rotate in unison. Indexing of the carrier tube 224 is performed by abruptly slowing the speed of rotation of the motor 190, so that the rotor 228 is permitted to rotate with respect to the hub assembly 230. As shown in FIGS. 13–15, the rotation of the rotor 228 with respect to the hub assembly 230 causes the pivotable member 234 to engage a tooth 240 of gear 236 to rotate the gear 236 and thus, rotate the carrier tube 224 about its longitudinal axis in a direction RI. The pivotable member 234 is reset to the pre-indexing position as shown in FIGS. 15–17 when the speed of rotation of the motor 190 is resumed so that the hub assembly 230 and rotor 228 again rotate in unison. Readings of the sample contained in the fluid tube present in carrier tube 224 can be taken at each indexing interval. Further details of the rotor assembly and indexing apparatus, the manner in which reading is performed, and the overall operation of the centrifuge device including a rotor assembly of this type, are disclosed in U.S. patent application Ser. No. 09/032,931, cited above.

Although only certain exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. An indexing apparatus, adaptable for use in a rotor of a centrifuge apparatus, to rotate a fluid tube about a rotational axis which is in substantial alignment with the longitudinal axis of the tube, the rotor being adapted to rotate the fluid tube in a rotational direction transverse to the longitudinal axis of the tube, the indexing apparatus comprising:

a rotatable member which is mechanically coupled to the fluid tube; and a driver, adapted to generate a driving force in response to a variation in a speed of rotation at which the rotor rotates the fluid tube in the rotational direction, and to apply the driving force to the rotatable member to control the rotatable member to rotate the fluid tube about the rotational axis, while the rotor is rotating the fluid tube in the rotational direction.

2. An apparatus as claimed in claim 1, wherein:

the rotatable member comprises a cam having a groove therein, and the driver comprises a cam follower which moves in the groove to engage and rotate the cam to rotate the fluid tube.

3. An apparatus as claimed in claim 2, wherein:

the cam defines the groove as a groove pattern disposed in a surface of the cam; and the groove pattern permits the cam follower to rotate the cam in a first rotational direction, and prevents the cam follower from rotating the cam in a second rotational direction opposite the first rotational direction.

4. An apparatus as claimed in claim 1, wherein:

the driver applies the driving force to the rotatable member to cause the rotatable member to rotate the fluid tube in increments defined by the rotatable member.

5. An apparatus as claimed in claim 1, wherein:

the rotatable member comprises a cam having a groove pattern therein; and the driver comprises a block and a cam follower which is coupled to the block and engages the groove pattern in the cam;

the block being movable along a direction transverse to a direction radial of the cam, such that the cam follower engages the groove pattern in the cam and rotates the cam when the block moves along the transverse direction.

6. An indexing apparatus, adaptable for use in a rotor of a centrifuge apparatus, to rotate a fluid tube about a rotational axis which is in substantial alignment with the longitudinal axis of the tube, comprising:

a rotatable member which is mechanically coupled to the fluid tube; and a driver, adapted to convert a centrifugal force generated by rotation of the rotor into a driving force, and to apply the driving force to the rotatable member to control the rotatable member to rotate the fluid tube about the rotational axis, while the rotor is rotating the fluid tube in a rotational direction transverse to the longitudinal axis of the tube.

7. An indexing apparatus, adaptable for use in a rotor of a centrifuge apparatus, to rotate a fluid tube about a rotational axis which is in substantial alignment with the longitudinal axis of the tube, comprising:

a rotatable member which is mechanically coupled to the fluid tube and comprises a cam having a groove pattern therein;

a driver, adapted to apply a driving force to the rotatable member to control the rotatable member to rotate the fluid tube about the rotational axis, while the rotor is rotating the fluid tube in a rotational direction transverse to the longitudinal axis of the tube, the driver comprising a block and a cam follower, which is coupled to the block and engages with the groove pattern in the cam, the block being movable along a direction transverse to a direction radial of the cam, such that the cam follower engages the groove pattern in the cam and rotates the cam when the block moves along the transverse direction; and an urging device which applies an urging force to the block to urge the block in a first direction along the transverse direction; and wherein the block is adapted to be urged in a second direction, substantially opposite the first direction, by centrifugal force generated by rotation of the rotor, and moves along the second direction when a magnitude of the centrifugal force is greater than a magnitude of the urging force.

8. An apparatus as claimed in claim 7, wherein:

the urging device comprises at least one spring.

9. A system for centrifuging fluid stored in a fluid tube, comprising:

a rotor, adapted to rotate the fluid tube in a rotational direction transverse to the longitudinal axis of the fluid tube; and an indexing device which, in response to a variation in a speed of rotation at which the rotor rotates the fluid tube in the rotational direction, rotates the fluid tube about a rotational axis which is in substantial alignment with the longitudinal axis of the tube while the rotor is rotating the fluid tube in the rotational direction.

10. A system as claimed in claim 9, wherein the indexing device further comprises:

a rotatable member which is mechanically coupled to the fluid tube; and a driver, adapted to apply a driving force to the rotatable member to rotate the fluid tube about the rotational axis, when the rotor is rotating the fluid tube in the rotational direction.

11. A system as claimed in claim 10, wherein:

the driver applies the driving force to the rotatable member to cause the rotatable member to rotate the fluid tube in increments defined by the rotatable member.

12. A system as claimed in claim 10, wherein:

the rotatable member is a cam having a groove therein, and the driver is a cam follower which moves in the groove to engage and rotate the cam to rotate the fluid tube.

13. A system for centrifuging fluid stored in a fluid tube, comprising:

a rotor, adapted to rotate the fluid tube in a rotational direction transverse to the longitudinal axis of the fluid tube; and an indexing device, adapted to rotate the fluid tube about a rotational axis which is in substantial alignment with the longitudinal axis of the tube while the rotor is rotating the fluid tube in the rotational direction, wherein the indexing device comprises:

a rotatable member which is mechanically coupled to the fluid tube; and a driver, adapted to convert a centrifugal force generated by rotation of the rotor into a driving force which drives the rotatable member to rotate the fluid tube about the rotational axis while the rotor is rotating the fluid tube in the rotational direction.

14. A method for centrifuging fluid stored in a fluid tube, comprising the steps of:

rotating the fluid tube in a rotational direction transverse to the longitudinal axis of the fluid tube;

varying a speed of rotation of the fluid tube in the transverse rotational direction to generate a driving force; and applying the driving force to the fluid tube to rotate the fluid tube about a rotational axis which is in substantial alignment with the longitudinal axis of the fluid tube while the fluid tube is being rotated in the rotational direction.

15. A method as claimed in claim 14, wherein the applying step comprises the step of:

rotating a rotatable member, which is mechanically coupled to the fluid tube, to rotate the fluid tube about the rotational axis.

16. A method as claimed in claim 14, further comprising the step of:

placing the tube in a rotor; and wherein the transverse rotational direction rotating step comprises the step of rotating the rotor.

17. A method as claimed in claim 14, wherein:

the rotational axis rotating, step comprises the steps of rotating the fluid tube about the rotational axis incrementally.

18. A method as claimed in claim 14, wherein:

the rotational axis rotating step permits rotation of the fluid tube in a first rotational direction about the rotational axis while preventing rotation of the fluid tube in a second rotational direction, opposite the first rotational direction, about the rotational axis.

19. A method for centrifuging fluid stored in a fluid tube, comprising the steps of:

placing the tube in a rotor;

rotating the rotor to rotate the fluid tube in a rotational direction transverse to the longitudinal axis of the fluid tube; and converting centrifugal force generated by rotation of the rotor into rotational force which rotates the fluid tube about a rotational axis which is in substantial alignment with the longitudinal axis of the tube while the fluid tube is being rotated in the rotational direction.

* * * * *